US008341783B2

(12) United States Patent
Beck

(10) Patent No.: US 8,341,783 B2
(45) Date of Patent: Jan. 1, 2013

(54) BABY CHANGE MAT

(76) Inventor: Jennifer Kara Beck, Ottawa (CA)

( * ) Notice: Subject to any disclaimer, the term of this patent is extended or adjusted under 35 U.S.C. 154(b) by 0 days.

(21) Appl. No.: 13/186,841

(22) Filed: Jul. 20, 2011

(65) Prior Publication Data

US 2012/0030877 A1 Feb. 9, 2012

Related U.S. Application Data

(60) Provisional application No. 61/370,866, filed on Aug. 5, 2010.

(51) Int. Cl.
*A47D 15/00* (2006.01)

(52) U.S. Cl. ..... 5/655; 5/484; 5/485; 5/417

(58) Field of Classification Search ..... 5/655, 93.2, 5/484, 485, 417, 420
See application file for complete search history.

(56) References Cited

U.S. PATENT DOCUMENTS 4,566,130 A * 1/1986 Coates ..... 383/15
4,886,150 A * 12/1989 Fitzsimmons ..... 190/1
5,743,649 A * 4/1998 Gonzalez ..... 383/6
6,298,509 B1 * 10/2001 Vickers ..... 5/655
6,785,921 B1 * 9/2004 Conforti ..... 5/655
D508,181 S 8/2005 Welch
7,350,252 B2 * 4/2008 Telegadis et al. ..... 5/655
7,520,010 B2 4/2009 Welch
8,069,517 B1 * 12/2011 Bush et al. ..... 5/655
2007/0240261 A1 * 10/2007 Yazarlo-Stahl et al. ..... 5/484

* cited by examiner

*Primary Examiner* — Michael Trettel
(74) *Attorney, Agent, or Firm* — Ottawa Patent Agency Incorporated; Peter Kwa

(57) ABSTRACT

A baby change mat has a rectangular base mat, and pockets attached to a side of the base mat. The base mat has a non-slip fastening belt for fastening the base mat to a change table. The base mat provides a first work surface for changing a baby. The pocket provides storage space for storing items needed for changing the baby. A cover is detachably attached to the base mat for providing a second work surface. A flap is detachably attached to a side of the rectangular base mat. The flap can be folded on top of the base mat or the cover for providing a third work surface. The baby change mat can be rolled up and held in the rolled up configuration with an elastic closure loop. A carrying handle facilitates attaching the rolled up baby change mat to a support such as a baby stroller.

13 Claims, 2 Drawing Sheets

BABY CHANGE MAT

This application claims the benefit of U.S. Provisional Application No. 61/370,866 filed Aug. 5, 2010.

FIELD OF THE INVENTION

The present invention relates to baby change mats, and especially to change mats for changing a baby when travelling or away from home.

BACKGROUND OF THE INVENTION

Public baby change areas may provide little counter space on which to lay out the items needed for changing the baby. In many instances, a change table is pulled down from a wall mounted unit and there may be no counter space at all.

A further problem is that there may be a hook to hang a diaper bag up on, but the diaper bag may have to be placed on a possibly dirty floor. In either case, the items needed for changing the baby would be in the diaper bag at arms length away from the caregiver.

SUMMARY OF THE INVENTION

The present invention avoids the problems of the prior art.

According to the invention, there is provided a baby change mat comprising a rectangular base mat, and at least one pocket attached to a side of the rectangular base mat. The base mat is adapted for providing a first work surface for changing a baby. The pocket provides storage space for items needed to change the baby.

Preferably, the base mat comprises a top layer and a bottom layer. The top layer is soft and absorbent, the bottom layer is water proof. More preferably, the top layer comprises cotton velour and the bottom layer comprises polyurethane laminate (PUL).

Preferably, the baby change mat further comprises a cover and matching fasteners for detachably attaching the cover to the base mat. The cover is adapted for providing a second work surface for changing the baby. More preferably, the cover comprises a top layer and a bottom layer. The top layer is soft and absorbent, the bottom layer is water proof. Even more preferably, the top layer comprises cotton velour and the bottom layer comprises polyurethane laminate (PUL). In the alternative, the cover may be made of a disposable material.

Preferably, the baby change mat further comprises an elastic closure loop attached to a side of the base mat. After rolling up the baby change mat, the elastic closure loop can be slipped over the rolled up baby change mat so as to hold the baby change mat in a rolled up configuration.

Preferably, the baby change mat further comprises a carrying handle detachably attached to the base mat for carrying the baby change mat in the rolled up configuration. In the alternative, the carrying handle may be fixedly attached to the base mat.

Preferably, the baby change mat further comprises a flap attached to a side of the base mat. The flap is foldable over the base mat or the cover attached to the base mat. The flap is adapted for providing a third work surface for changing the baby. More preferably, the flap is detachable attached to the side of the base mat. Even more preferably, the flap comprises a top layer and a bottom layer. The top layer is soft and absorbent, the bottom layer is water proof. Yet even more preferably, the top layer comprises cotton velour and the bottom layer comprises polyurethane laminate (PUL). In the alternative, the cover may be made of a disposable material.

Preferably, the base mat has a pair of slits for threading therethrough a safety strap of a change table for preventing a baby to be changed from rolling off the change table.

Preferably, the at least one pocket provides sufficient storage space for holding a day worth of items needed for changing a baby. More preferably, the at least one pocket provides sufficient storage space for holding a day worth of items needed for changing a cloth-diapered baby.

Preferably, the base mat has a fastening belt secured to the underside of the base mat for fastening the base mat to a change table. More preferably, the fastening belt has a non-slip surface for preventing the base mat from slipping off the change table.

BRIEF DESCRIPTION OF THE DRAWINGS

The drawings illustrate the preferred embodiments of the present invention by way of example only.

DETAILED DESCRIPTION OF THE PREFERRED EMBODIMENTS

Figure 1:
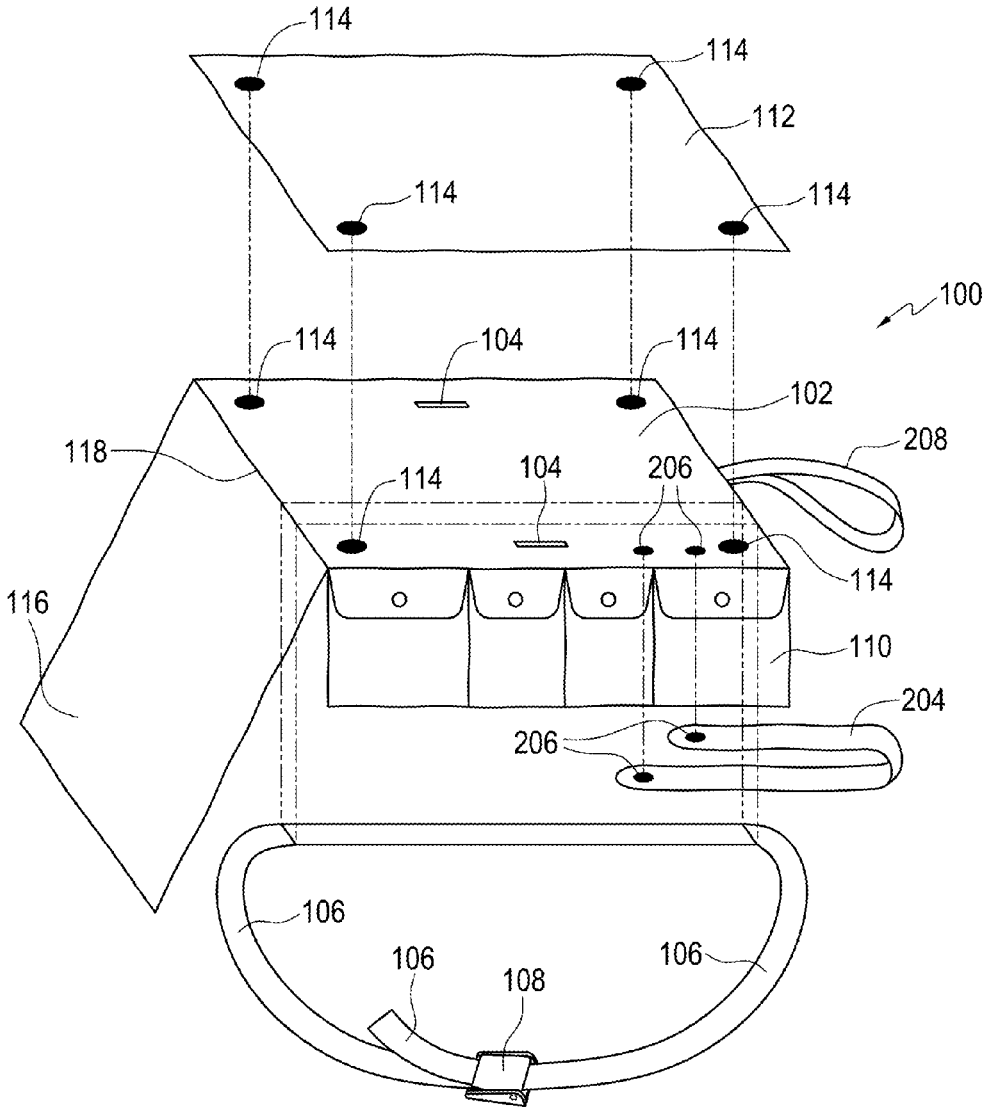
FIG. 1 shows an exploded view of a preferred embodiment of a baby change mat according to the invention.

The following descriptions describe the preferred embodiments of the present invention by way of example only. FIG. 1 shows an exploded view of a baby change mat which is generally indicated with the reference numeral 100. The baby change mat 100 has a base mat 102. The base mat 102 has a pair of slits 104 for threading a safety strap (not shown) of a change table (not shown) through the pair of slits 104 for preventing a baby to be changed (not shown) from rolling off the change table. A fastening belt 106 with a belt clip 108 on one end of the fastening belt 106 is secured to the underside of the base mat 102 for fastening the base mat 102 to the change table. The belt clip 108 can be opened, the other end of the fastening belt 106 can be pulled so as to tighten the fastening belt 106 snugly around the change table. A plurality of pockets 110 is attached to the long front side of the rectangular base mat 102 to hold items needed for changing the baby, such as a day worth of diapers and wipes. The pockets 110 may be attached to one of the other sides of the base mat 102 or to more than one side of the base mat 102.

Preferably, the surface of the fastening belt 106 which comes into contact with the change table comprises a non-slip surface, such as a rubberized surface, so as to help prevent the base mat 102 from slipping off the change table even when the base mat 102 is weighed down by pockets 110 with contents.

Preferably, the base mat 102 has a top layer and a bottom layer. The top layer is soft and absorbent, such as cotton velour. The bottom layer is waterproof, such as polyurethane laminate (PUL). Any soil will therefore be contained on the base mat 102.

A cover 112 is detachably snapped on the base mat 102 with matching snaps 114. The cover 112 provides an additional work surface for changing the baby. Should the cover 112 gets soiled, the cover 112 can be detached from the base mat 102, and the baby can be changed on the base mat 102.

Preferably, the cover 112 has a top and a bottom layer. The top layer is soft and absorbent, such as cotton velour. The bottom layer is waterproof, such as polyurethane laminate (PUL). Any soil will therefore be contained on the cover 112.

In the alternative, the cover 112 may be made of a disposable material.

A flap 116 is detachably attached to a short side of the rectangular base mat 102 with a zipper 118. The flap 116 can be folded on top of the base mat 102. The flap 116 then provides a yet additional work surface for changing the baby. Should the flap 116 gets soiled, the flap 116 can be detached from the base mat 102, and the baby can be changed on the base mat 102 or on the cover 112.

Preferably, the flap 116 has a top and a bottom layer. The top layer is soft and absorbent, such as cotton velour. The bottom layer is waterproof, such as polyurethane laminate (PUL). Any soil will therefore be contained on the flap 116.

In the alternative, the flap 116 may be made of a disposable material.

Similarly, additional flaps (not shown) may be detachably attached to the other sides of the base mat 102 for providing even more additional work surfaces. Preferably, the additional flaps have a top and a bottom layer. The top layer is soft and absorbent, such as cotton velour. The bottom layer is waterproof, such as polyurethane laminate (PUL). Any soil will therefore be contained on the flaps.

In the alternative, the additional flaps may be made of disposable materials.

Figure 2:
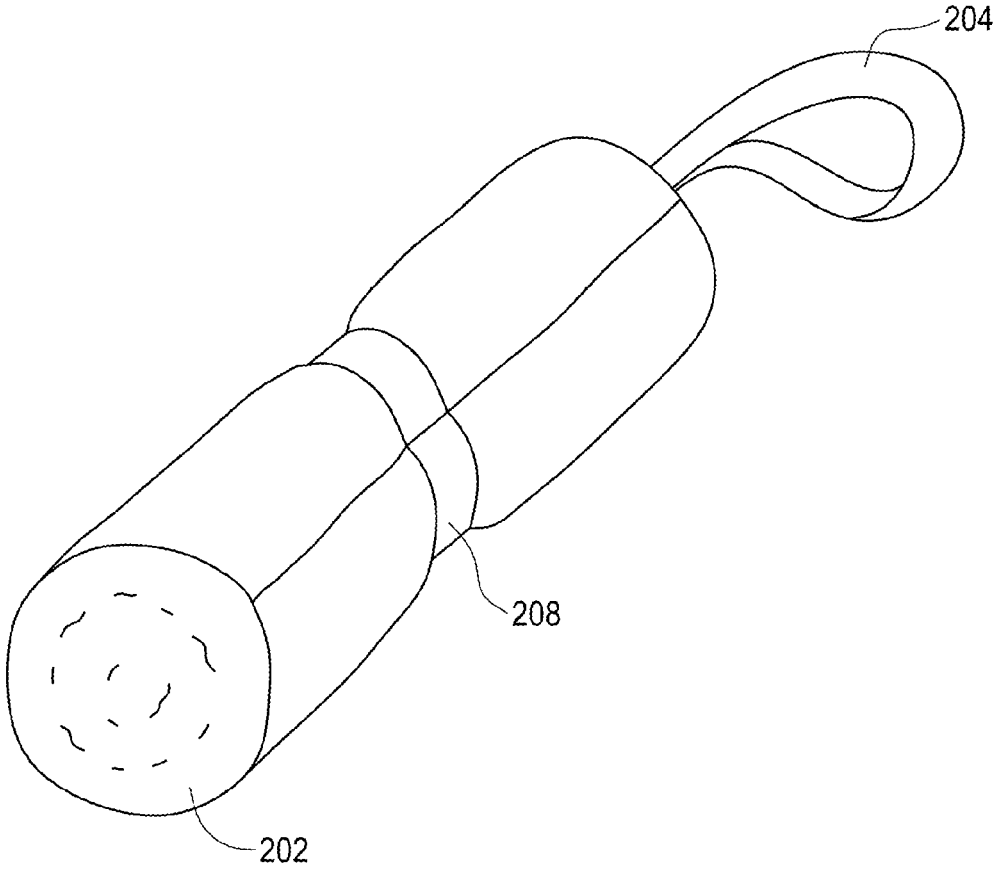
FIG. 2 shows the baby change mat in a rolled up configuration.

FIG. 2 shows the baby change mat 100 rolled up in a rolled up configuration 202. An elastic closure loop 208, also shown in FIG. 1, is sewn into a seam of a short side of the base mat 102. The elastic closure loop 208 holds the baby change mat 100 in the rolled up configuration 202. The elastic closure loop 208 stretches as the diameter of the rolled up configuration 202 expands with the pockets 110 being filled.

A carrying handle 204, also shown in FIG. 1, is detachably snapped on the underside of the base mat 102 with snaps 206. The carrying handle 204 facilitates attaching the carrying handle 204 to a baby stroller or some other support. An additional carrying handle may be attached to the base mat 102 so that there are carrying handles on both sides of the rolled up configuration 202.

In the alternative, the carrying handle 204 and the additional carrying handle may be fixedly attached to the underside of the base mat 102 with rivets (not shown).

A person skilled in the art will have by now appreciated the full scope of the invention. In particular, the scope of the invention is not limited to the preferred embodiments described by way of example in the above.

I claim:

1. A baby change mat, comprising:

a rectangular base mat for providing a first work surface for changing a baby, the base mat comprising a base top layer and a base bottom layer, the base top layer being soft and absorbent, the base bottom layer being water proof, the base mat defining a pair of slits for threading therethrough a safety strap of a change table, the safety strap for preventing the baby from rolling off the change table; and at least one pocket attached to a side of the rectangular base mat, the at least one pocket for providing storage space for items needed to change the baby.

2. A baby change mat, comprising:

a rectangular base mat for providing a first work surface for changing a baby, the base mat comprising a base top layer and a base bottom layer, the base top layer being soft and absorbent, the base bottom layer being water proof;

at least one pocket attached to a side of the rectangular base mat, the at least one pocket for providing storage space for items needed to change the baby; and a fastening belt secured to the underside of the base mat, the fastening belt for fastening the base mat to a change table.

3. A baby change mat as defined in claim 2, wherein the fastening belt has a non-slip surface for preventing the base mat from slipping off the change table.

4. A baby change mat, comprising:

a rectangular base mat for providing a first work surface for changing a baby, the base mat comprising a base top layer and a base bottom layer, the base top layer being soft and absorbent, the base bottom layer being water proof;

at least one pocket attached to a side of the rectangular base mat, the at least one pocket for providing storage space for items needed to change the baby; and a flap for providing a third work surface for changing the baby, the flap comprising a flap top layer and a flap bottom layer, the flap top layer being soft and absorbent, the flap bottom layer being water proof, the flap attached to a side of the base mat, the flap foldable over the base mat.

5. A baby change mat as defined in claim 4, wherein the flap is detachably attached to the base mat and the flap is made of a disposable material.

6. A baby change mat as defined in claim 4, wherein the flap top layer comprises cotton velour and the flap bottom layer comprises polyurethane laminate (PUL).

7. A baby change mat as defined in claim 1 or claim 2 or claim 4, further comprising an elastic closure loop attached to a side of the base mat so that upon rolling up the baby change mat, the elastic closure loop can be slipped over the rolled up baby change mat so as to hold the baby change mat in a rolled up configuration.

8. A baby change mat as defined in claim 7, further comprising a carrying handle attached to the base mat, the carrying handle for carrying the baby change mat in the rolled up configuration.

9. A baby change mat as defined in claim 1 or claim 2 or claim 4, wherein the base top layer comprises cotton velour and the base bottom layer comprises polyurethane laminate (PUL).

10. A baby change mat as defined in claim 1 or claim 2 or claim 4, wherein the at least one pocket provides sufficient storage space for holding a day worth of items needed for changing a cloth-diapered baby.

11. A baby change mat as defined in claim 1 or claim 2 or claim 4, further comprising:

a cover for providing a second work surface for changing the baby, the cover comprises a cover top layer and a cover bottom layer, the cover top layer being soft and absorbent, the cover bottom layer being water proof; and matching fasteners for detachably attaching the cover to the base mat.

12. A baby change mat as defined in claim 11, wherein the cover top layer comprises cotton velour and the cover bottom layer comprises polyurethane laminate (PUL).

13. A baby change mat as defined in claim 11, wherein the cover is made of a disposable material.

* * * * *